US011596214B2

(12) United States Patent
Dao et al.

(10) Patent No.: US 11,596,214 B2
(45) Date of Patent: Mar. 7, 2023

(54) PURSE WITH SECURITY AND SAFETY FEATURES

(71) Applicants: Joan Dao, Roseville, MN (US); Laura Ziegelski, Minneapolis, MN (US); Kristine Johnson, Minneapolis, MN (US); Julie Weber, Minneapolis, MN (US); Alex Lavalley, Minneapolis, MN (US); Abigail Meyer, Minneapolis, MN (US); Shannon Moskowitz, Irvine, CA (US); Samuel Taylor Finnegan, Eden Prairie, MN (US)

(72) Inventors: Joan Dao, Roseville, MN (US); Laura Ziegelski, Minneapolis, MN (US); Kristine Johnson, Minneapolis, MN (US); Julie Weber, Minneapolis, MN (US); Alex Lavalley, Minneapolis, MN (US); Abigail Meyer, Minneapolis, MN (US); Shannon Moskowitz, Irvine, CA (US); Samuel Taylor Finnegan, Eden Prairie, MN (US)

(73) Assignee: ILESOVI INC., Roseville, MN (US)

( * ) Notice: Subject to any disclaimer, the term of this patent is extended or adjusted under 35 U.S.C. 154(b) by 554 days.

(21) Appl. No.: 16/349,967

(22) PCT Filed: Jul. 12, 2018

(86) PCT No.: PCT/US2018/041910

§ 371 (c)(1),
(2) Date: May 14, 2019

(87) PCT Pub. No.: WO2019/014504

PCT Pub. Date: Jan. 17, 2019

(65) Prior Publication Data

US 2019/0328098 A1 Oct. 31, 2019

Related U.S. Application Data

(60) Provisional application No. 62/531,860, filed on Jul. 12, 2017.

(51) Int. Cl.
*A45C 13/18* (2006.01)
*A45C 1/02* (2006.01)
(Continued)

(52) U.S. Cl.
CPC ..... *A45C 13/185* (2013.01); *A45C 1/02* (2013.01); *A45C 3/06* (2013.01); *A45C 13/126* (2013.01); *A45C 13/24* (2013.01)

(58) Field of Classification Search
CPC ..... A45C 13/185; A45C 13/24; A45C 13/04; E05B 65/52; E05B 65/5207; E05B 65/5223
See application file for complete search history.

(56) References Cited

U.S. PATENT DOCUMENTS 17,545 A * 6/1857 Zenfel ..... A45C 13/04 190/122
1,155,475 A * 10/1915 Fay ..... B65D 37/00 220/9.3
(Continued)

FOREIGN PATENT DOCUMENTS

CN 2935714 Y 8/2007
CN 203913722 U 11/2014
(Continued)

OTHER PUBLICATIONS

Search Report and Written Opinion for PCT/US2018/041910, dated Sep. 27, 2018, 9 pages.

*Primary Examiner* — John K. Fristoe, Jr.
*Assistant Examiner* — Justin Caudill
(74) *Attorney, Agent, or Firm* — Skaar Ulbrich Macari, P.A.

(57) ABSTRACT

Disclosed is a bag or purse for containing valuables. The bag or purse includes a rigid endoskeleton, an exterior covering disposed over the rigid endoskeleton, a lock assembly coupled to the endoskeleton, a biometric sensor and a microcontroller. The lock assembly prevents access to the interior space when the lock assembly is in a locked state. The lock assembly includes a handle and an actuator. The actuator is arranged within the lock assembly to selectively allow the lock assembly to unlock from a locked state. The microcontroller is programmed to determine whether an input provided to the biometric sensor corresponds with an authorized user and, if affirmative, activate the actuator to allow the lock assembly to achieve the unlocked state, and if negative, to not allow the lock assembly to achieve the unlocked state. A quick release cross body shoulder strap and GPS tracking feature can also be provided.

20 Claims, 15 Drawing Sheets

(51) Int. Cl.

| | |
|---|---|
| ***A45C 3/06*** | (2006.01) |
| ***A45C 13/12*** | (2006.01) |
| ***A45C 13/24*** | (2006.01) |

(56) References Cited

U.S. PATENT DOCUMENTS 1,601,047 A * 9/1926 Shwayder ..... A45C 13/04 190/121
2,806,563 A * 9/1957 Einhorn ..... A45C 7/0036 190/107
3,613,843 A * 10/1971 Davis ..... A45C 3/004 206/292
4,945,740 A * 8/1990 Kawano ..... B60R 25/02142 70/248
5,408,220 A * 4/1995 Brown ..... A45C 13/18 150/110
5,476,184 A * 12/1995 Hill ..... A45C 7/0077 383/127
6,131,713 A * 10/2000 Sher ..... A45C 5/14 190/122
6,133,831 A * 10/2000 Kyles ..... A45C 13/24 340/568.1
6,260,680 B1 * 7/2001 Lin ..... A45C 5/03 190/115
6,295,702 B1 * 10/2001 Bauer ..... A45C 13/1069 24/303
8,365,365 B2 2/2013 Schlipper
8,847,760 B1 * 9/2014 Watkins, Jr. ..... A45C 13/24 340/568.7
9,161,596 B2 10/2015 Schlipper
9,357,823 B2 * 6/2016 Boldetti ..... A45C 3/02
9,409,679 B2 * 8/2016 Rumbough ..... A45C 3/04
2002/0033607 A1 * 3/2002 Worrall ..... E05B 63/0069 292/202
2004/0066366 A1 4/2004 Jung et al.
2004/0090773 A1 * 5/2004 Bryan ..... H02J 7/0044 362/156
2006/0118376 A1 * 6/2006 Godshaw ..... A45C 7/0036 190/115
2006/0266563 A1 11/2006 Kaplan
2009/0226050 A1 9/2009 Hughes
2010/0243114 A1 * 9/2010 Hai ..... A45C 13/20 150/102
2011/0186397 A1 8/2011 Sheikh
2012/0299528 A1 * 11/2012 Scarmozzino ..... A45C 13/001 320/101
2014/0298492 A1 * 10/2014 Simpson ..... G06F 21/88 726/35
2014/0311194 A1 * 10/2014 Berger ..... E05B 13/106 70/101
2016/0198827 A1 * 7/2016 Zibkoff Knoll ..... A45C 13/005 150/118
2016/0360351 A1 12/2016 Cabouli
2017/0302099 A1 * 10/2017 Bolden ..... A45C 15/00

FOREIGN PATENT DOCUMENTS

| | | | |
|---|---|---|---|
| CN | 104510113 | A | 4/2015 |
| CN | 204617312 | U | 9/2015 |
| CN | 205390634 | U | 7/2016 |
| CN | 206101875 | U | 4/2017 |

* cited by examiner

PURSE WITH SECURITY AND SAFETY FEATURES

PRIORITY

This application claims the benefit of U.S. Provisional Application Ser. No. 62/531,860, filed on Jul. 12, 2017, which is hereby incorporated herein by reference in its entirety.

FIELD

The present invention relates generally to the field of personal accessories, such as handbags and purses, and more specifically to a bag or purse including security and safety features.

BACKGROUND

Theft of handbags and purses is a continuing problem because they are tempting targets for thieves due to the perception of valuable contents and external wearing location by the owner. In addition to the theft of the items in the stolen bag or purse, the owner can be injured during the thief's attempt to forcibly remove the bag or purse from its owner. Moreover, the stolen bag or purse cannot be easily tracked, so recovery is unlikely.

Previous solutions to some of these concerns include slash-proof fabric used for purse body and shoulder strap, standard physical key locks, locking zippers and RFID-blocking technology. However, the previous solutions do not address all drawbacks well and also present respective drawbacks. For example, most anti-theft purse designs are of limited effectiveness because the technology utilized is specific for slash-and-run theft. Additionally, fabric choices limit customizability of the appearance of the purse. Loss of a key to unlock the purse, if applicable, is also a concern. RFID-blocking technology is of limited value, since few consumers own credit cards with RFID transmitters, and this technology only protects against one method of information theft.

The inability to track a bag or purse means that theft victims must rely on security cameras, suspect identification, tracking capability of devices such as cellphones that may have been in the stolen purse, and the police for stolen item recovery. Money and other valuables are unlikely to be recovered even if the thief is eventually caught because of the time required to investigate and locate a suspect.

Thus, there is an unmet need to provide a handbag or purse with features that discourage theft, minimize potential injury of victim during theft, and in the event of theft (1) protects items in purse, and (2) aids in recovery of purse.

SUMMARY

The invention set forth in this specification pertains to a new and improved bag or purse that discourages theft, minimizes potential injury of victim during theft, and in the event of theft (1) protects items in purse, and (2) aids in recovery of purse. Thus, the invention imparts a sense of safety and confidence to persons carrying valuable items in their purse or bag. Moreover, the invention can be configured to resemble a variety of standard purses and bags so that the owner need not sacrifice fashion in order to benefit from the enhanced security features.

The disclosure includes a bag or purse for containing valuables. The bag or purse includes a rigid endoskeleton, an exterior covering disposed over the rigid endoskeleton, a lock assembly coupled to the endoskeleton, a biometric sensor and a microcontroller. The lock assembly prevents access to the interior space when the lock assembly is in a locked state. The lock assembly includes a handle and an actuator. The actuator is arranged within the lock assembly to selectively allow the lock assembly to unlock from a locked state. The microcontroller is programmed to determine whether an input provided to the biometric sensor corresponds with an authorized user and, if affirmative, activate the actuator to allow the lock assembly to achieve the unlocked state, and if negative, to not allow the lock assembly to achieve the unlocked state. A quick release cross body shoulder strap and GPS tracking feature can also be provided.

The bag or purse is versatile for different fashion styles (thanks to endoskeletal lining). Thus, the invention can be configured according to a wide variety of styles and shapes. The bag or purse is more secure due to the combination of integrated technologies. Also, the keys cannot be lost when equipped with a biometric lock. Plus, in the event of theft, items inside will be difficult to access inside of the purse/bag, and the purse/bag can be tracked to aid in quick capture of the thief. Additionally, the shoulder strap can detach when a force threshold is exceeded in order to protect against collarbone injury of the wearer.

The bag or purse can be adapted to a variety of accessories, including secure camera bags, backpacks, duffle bags, etc.

The disclosure includes a bag, such as a purse, for containing valuables. The bag or purse includes a rigid endoskeleton defining an interior space, an exterior covering disposed over the rigid endoskeleton, a lock assembly coupled to the endoskeleton and arranged to prevent access to the interior space when the lock assembly is in a locked state. The lock assembly includes a handle and an actuator. The actuator is arranged within the lock assembly to selectively allow the lock assembly to unlock from a locked state. A biometric sensor can be provided to the bag. A microcontroller is coupled to the biometric sensor and the actuator. The microcontroller is programmed to determine whether an input provided to the biometric sensor corresponds with an authorized user and, if affirmative, activate the actuator to allow the lock assembly to achieve the unlocked state, and if negative, to not allow the lock assembly to achieve the unlocked state.

The bag can include a shoulder strap. The shoulder strap comprising a first end coupled to the rigid endoskeleton and an opposing second end coupled to the rigid endoskeleton. At least one of the first and second ends can be coupled to the rigid endoskeleton via a force sensitive shoulder strap connector, the connector configured to decouple when a force above a preset threshold is applied to the shoulder strap.

The endoskeleton can include a planar base plate, a top support member, and a plurality of rigid cables extending between the top support member and the base plate.

The bag can include a slash-resistant inner lining provided to the interior space of the endoskeleton. The exterior covering can also be slash resistant.

A power source, such as a battery, can be coupled to the microcontroller. The battery can be configured for wireless charging.

The lock assembly can comprise a lock body, a lock wheel rotationally disposed at least partially within the lock body via a pivot pin, a push block disposed within the lock body and an actuator. The push block is arranged with respect to the lock wheel such that the push block defines a rotational blocking position and a rotational permissive position. The actuator is coupled to the push block to move the push block between the rotational blocking position and the rotational permissive position. A handle is coupled to the lock wheel so that the lock wheel can be manually rotated by the user to re-lock the lock assembly. A torsion spring can be coupled to the lock body and the lock wheel to turn the wheel from a locked position to an unlocked position when the push block is in the rotational permissive position. The push block can define a head portion that is relatively thicker as compared to a tail portion thereof.

The biometric sensor can be a finger print scanner. The actuator can be a solenoid. The lock assembly can include a lock state sensor coupled to the microcontroller. For example, the lock state sensor can be a photoreceptor or a proximity sensor. A global positioning system (GPS) decoder can be coupled to a wireless transponder and the microcontroller. The microcontroller can be programmed to cause the wireless transponder to broadcast the GPS location coordinates of the bag. An audible panic alarm can be coupled to the microcontroller.

The disclosure further includes a method of securing bag against unauthorized access to contents of the bag. A biometric input of a user to a biometric sensor can be provided. It can be determined whether the biometric input provided to the biometric sensor corresponds with an authorized user. An endoskeleton can be provided to the interior of the bag. An actuator in the lock assembly can be activated to place the lock assembly into an unlocked state from a locked state by moving a push block which permits a lock wheel to rotate from a locked position to an unlocked position. A panic alarm can be triggered if a strap of the bag is uncoupled from the bag on at least one end of the strap. A set of GPS coordinates for the bag can be wirelessly broadcast by a transponder provided to the bag.

The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
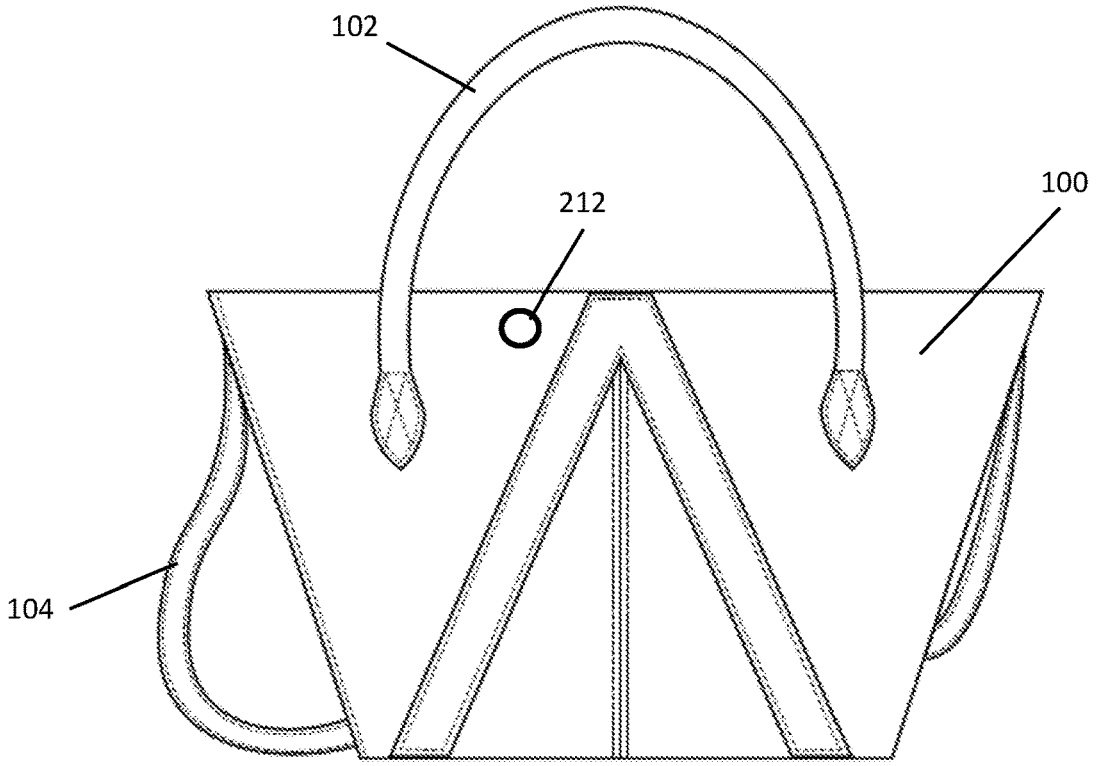
FIG. 1 is a front view of a purse with security and safety features, in accordance with embodiments of the present invention.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the spirit and scope of the invention as defined by the appended claims.

DETAILED DESCRIPTION

In the following descriptions, the present invention will be explained with reference to example embodiments thereof. However, these embodiments are not intended to limit the present invention to any specific example, embodiment, environment, applications, or implementations described in these embodiments. Therefore, description of these embodiments is only for purpose of illustration rather than to limit the present invention.

The following examples discuss a purse as the article to which the invention is adapted. However, the invention can take the form of a bag, backpack, suitcase, briefcase, luggage or other storage accessory that is used to protect personal valuables.

Figure 2:
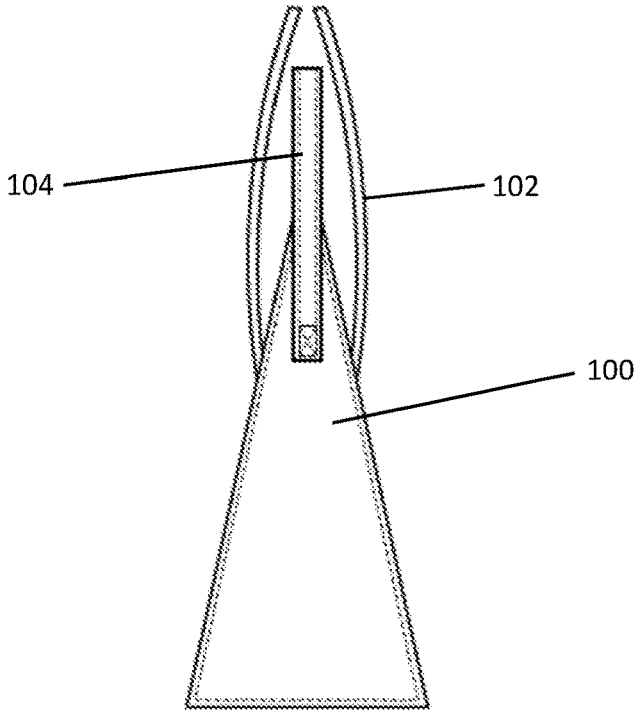
FIG. 2 is a side view of a purse with security and safety features, in accordance with embodiments of the present invention.

Referring first to FIGS. 1-2, the purse 100 is configured and styled to appear much like a conventional purse despite possessing several components such that the purse 100 is configured as a personal security Internet of Things (IOT) wearable, smart purse to protect personal valuables.

The exterior body is formed of a fabric or leather outer covering and can be styled in any desired form. The purse includes an internal lining that is slash and puncture resistant. This lining functions to thwart common slash/puncture attacks by pickpockets and other thieves. The internal lining also allows customization on the outside for any desired fabrics. The seams can also be reinforced with stainless steel cable for strength. The inner lining can also be omitted and the exterior instead formed of the slash and puncture resistant material.

Handles 102 and a shoulder strap 104 can be provided to the purse 100. These items can be configured to break away or release from the main purse body 101 when subjected to a force greater than a preset value as will be discussed in greater detail below.

Figure 3:
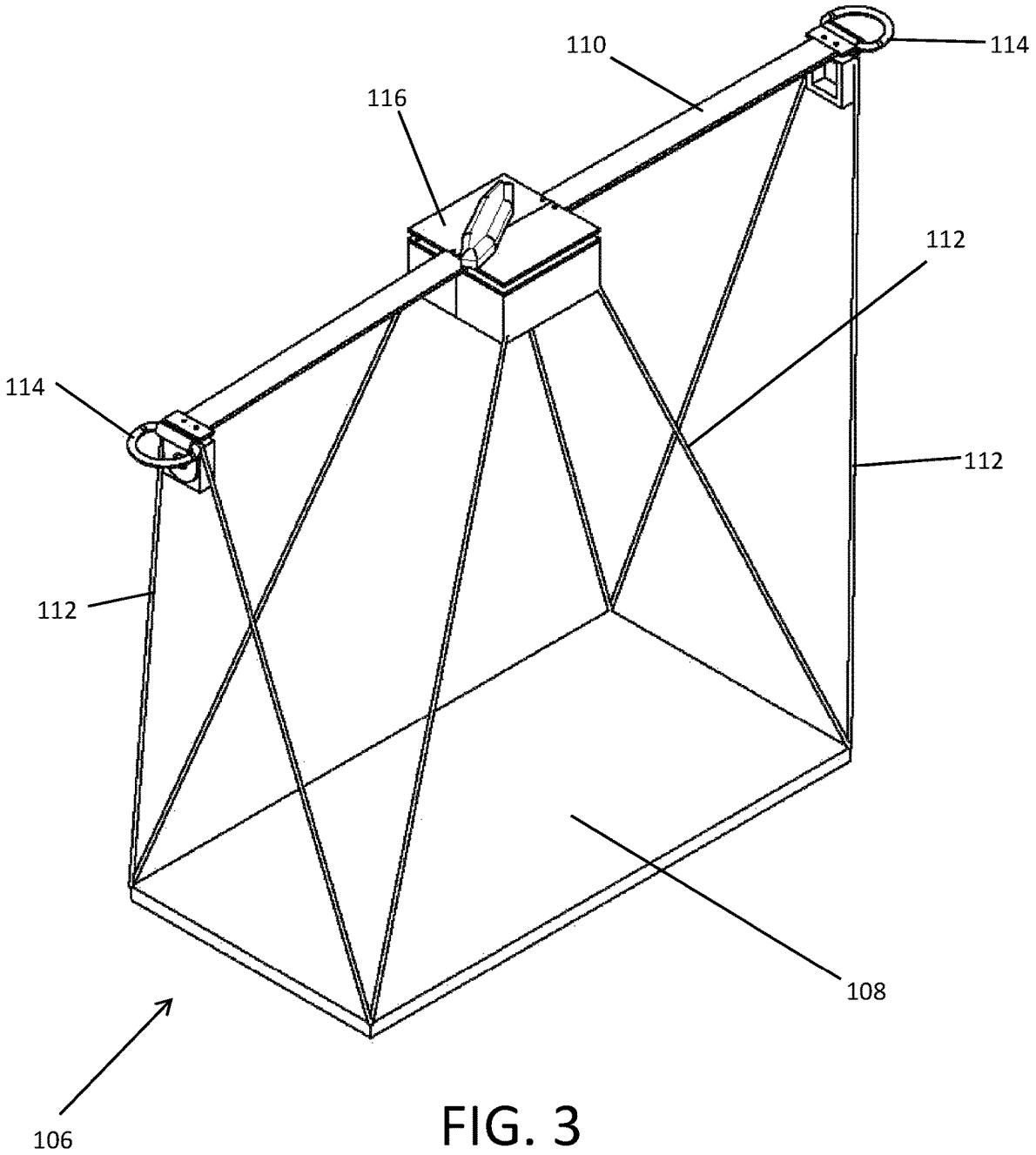
FIG. 3 is a perspective view of an endoskeleton structure for a purse with security and safety features, in accordance with embodiments of the present invention.
Figure 4:
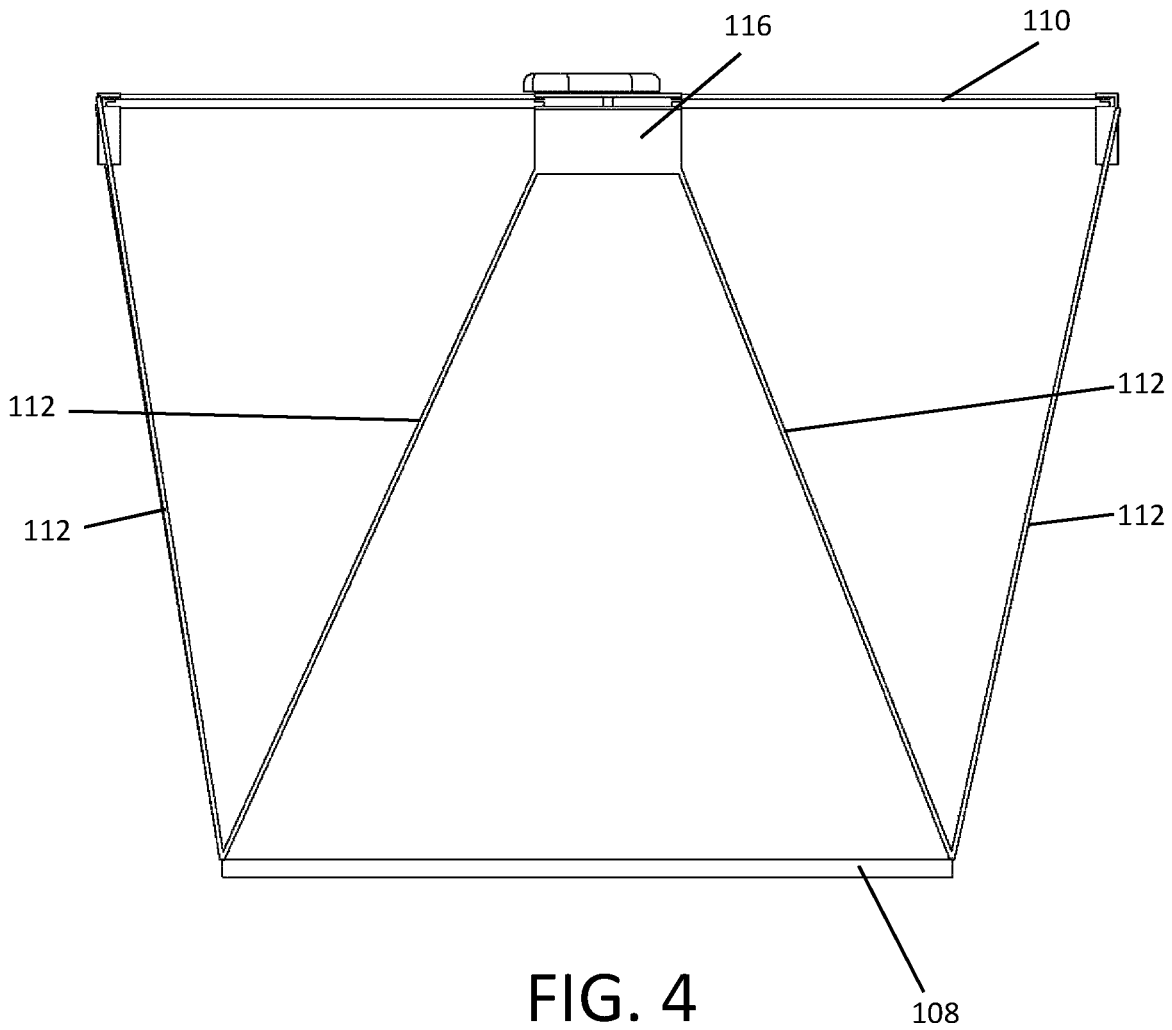
FIG. 4 is a front view of an endoskeleton structure for a purse with security and safety features, in accordance with embodiments of the present invention.
Figure 5:
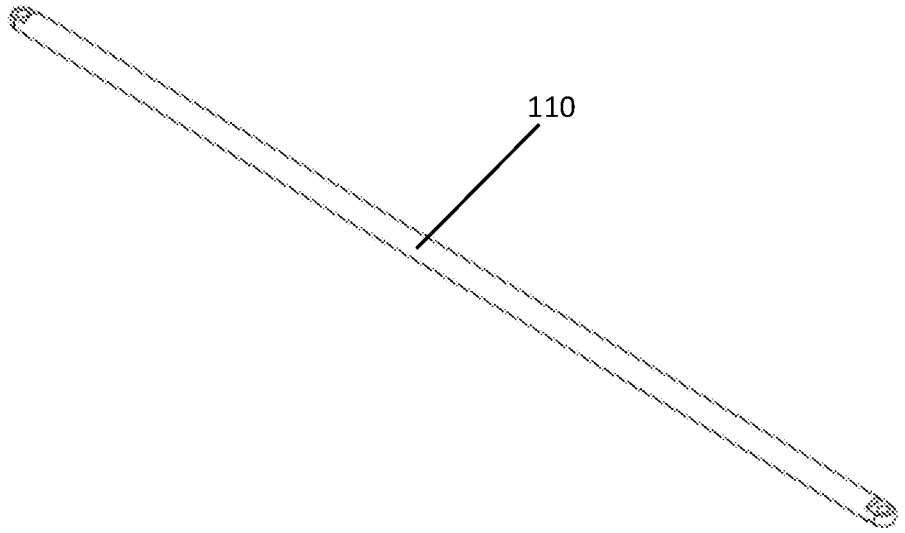
FIG. 5 is a perspective view of a top support for an endoskeleton structure for a purse with security and safety features, in accordance with embodiments of the present invention.

Referring now to FIGS. 3-4, the internal endoskeleton structure 106 (also referred to as the frame) for the purse is illustrated. The bottom 108 is formed as a solid planar base. The bottom 108 can be formed of a rigid material, such as metal, plastic, carbon fiber, Kevlar or other composite. A top support member 110 (also shown in FIG. 5) spans across the top of the endoskeleton parallel to the bottom 108. The top support can be an elongated metal strip or can be formed of other strong rigid material.

A plurality of rigid cables 112 span between the bottom 108 and the top 110 members. In particular, the cables span between the four outer corners of the bottom 108 upwards to a respective outer corner of the top support member 110.

A D-ring 114 can be disposed at each of the longitudinal ends of the upper support member 110. This D-ring 114, or other connector feature, can extend through the exterior covering of the purse and be used to attach the shoulder strap, identification tag, or other items that users may desire to latch onto a ring of the purse.

A lock assembly 116 is disposed along the top support member 110 at an approximate midpoint thereof. Rigid cables 112 span from the lower corners of the lock assembly 116 to the respective corners of the bottom 108.

The endoskeleton 106 provides a rigid frame that supports the inner lining and the outer covering of the purse 100. Together, this rigid frame 106 and inner fabric layer, when the purse or bag is locked, deters thieves from accessing the contents inside of the bag or purse.

An example of suitable fabric for the inner lining is a natural fabric composite, such as linen, treated with high concentration of isopropyl alcohol and epoxy resins. Any combination of similar textile weaves, compositions, and treatment processes in addition to the example provided above fall within the scope of this invention. The lining can be further reinforced with steel cable in the seams for structural support.

The material is assembled and treated separate from the outer lining (leather or fabric of choice) and reassembled with the electronics in the final assembly process.

When assembling the bag or purse 100, the inner fabric layer and external fabric shell can be fully constructed first. Then, the bottom panel 108 of the endoskeleton 106 is placed in the bottom of the external fabric shell. The internal fabric layer constructed out of the treated fabric is placed on top of the endoskeleton base. The cables 112 and top support member 110 are added next and sewn onto the internal lining. The lock assembly 116 is then fastened to the top support member 110.

An additional inner fabric layer can be placed inside the inner support lining and sewn to the support lining and external fabric layer. This third layer serves aesthetic purposes as well as preventing the contents of the bag or purse from contacting the rough, internal support and circuitry.

Details of the lock assembly 116 are shown throughout FIGS. 6-26. The lock assembly 116 is a unique coffin design, generally comprising a wheel segment inside of a rectangular case. The case is divided into two bodies. When the two bodies are brought together, the wheel can be turned to secure the bodies together.

Figure 6:
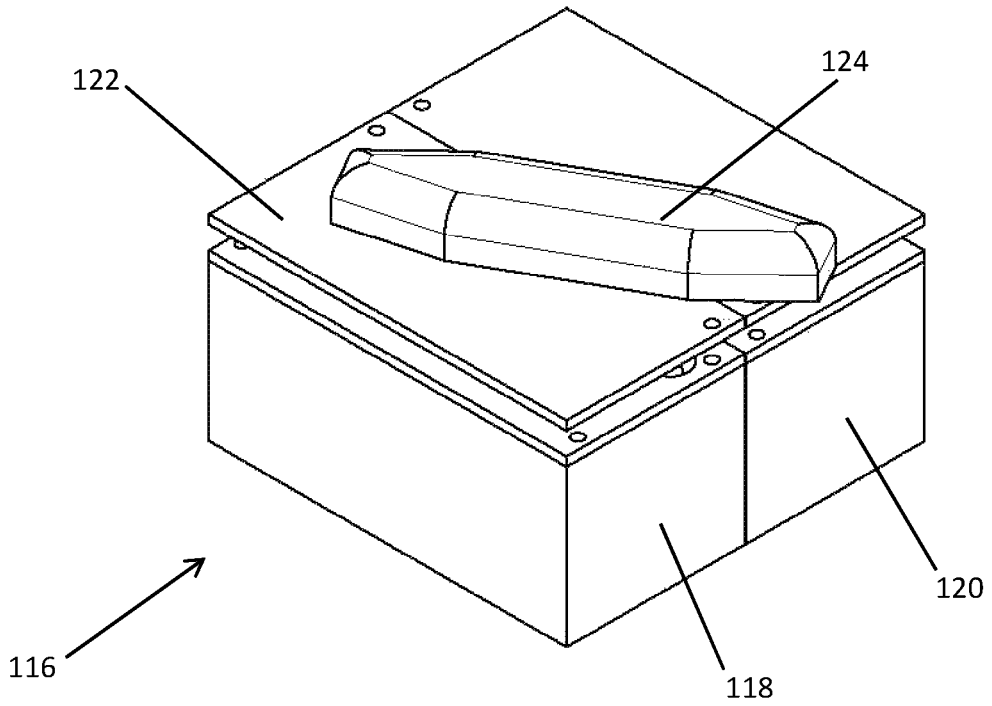
FIG. 6 is a perspective view of a lock assembly for a purse with security and safety features, in accordance with embodiments of the present invention.

Referring first to FIG. 6, the lock assembly 116 more particularly comprises a first housing body 118, a second housing body 120 disposed laterally next to the first body 118, a respective top plate 122 disposed atop each of the housing bodies 118, 120 and a handle 124 extending above the top plates 122.

Figure 7:
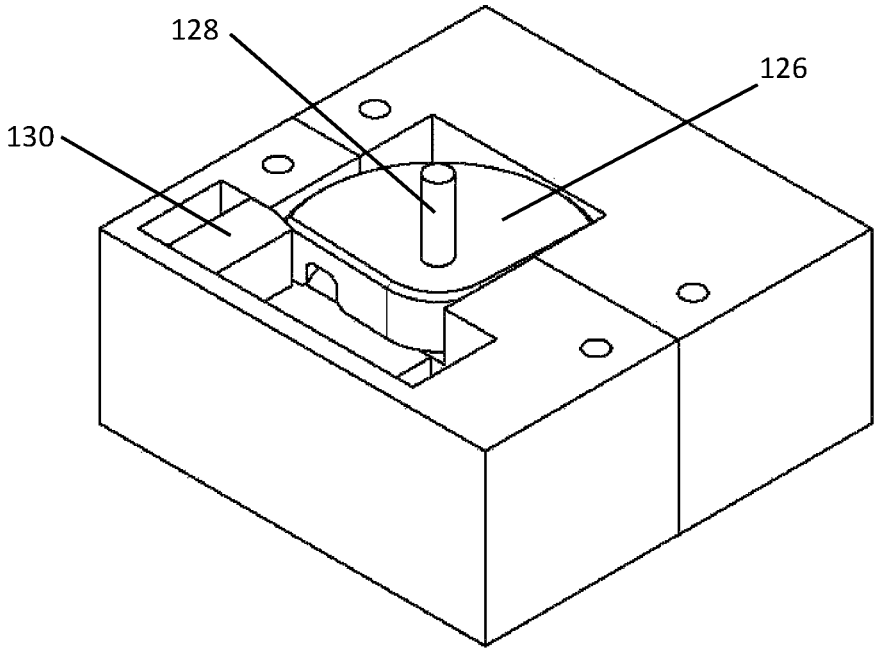
FIG. 7 is a perspective of the lock assembly of FIG. 6 showing additional structure, in accordance with embodiments of the present invention.

In FIG. 7, the top plates 122 and handle 124 have been removed so that internal details can be seen. A lock wheel 126 is disposed within a recess defined partially in each of the bodies 118, 120. A pivot pin 128 extends through the lock wheel 126 and into the first body 118. The pin extends upward so that the handle 124 mounts atop the pin 128 and can thus be used to manually actuate the lock wheel 126.

In the first body 118, another recess is defined in which a push block 130 is disposed. The push block is arranged adjacent to a flat side of the wheel 126 so that the push block 130 blocks rotation of the wheel unless the push block 130 is slid longitudinally in its recess to provide the clearance necessary for the wheel 126 to rotate.

Figure 8:
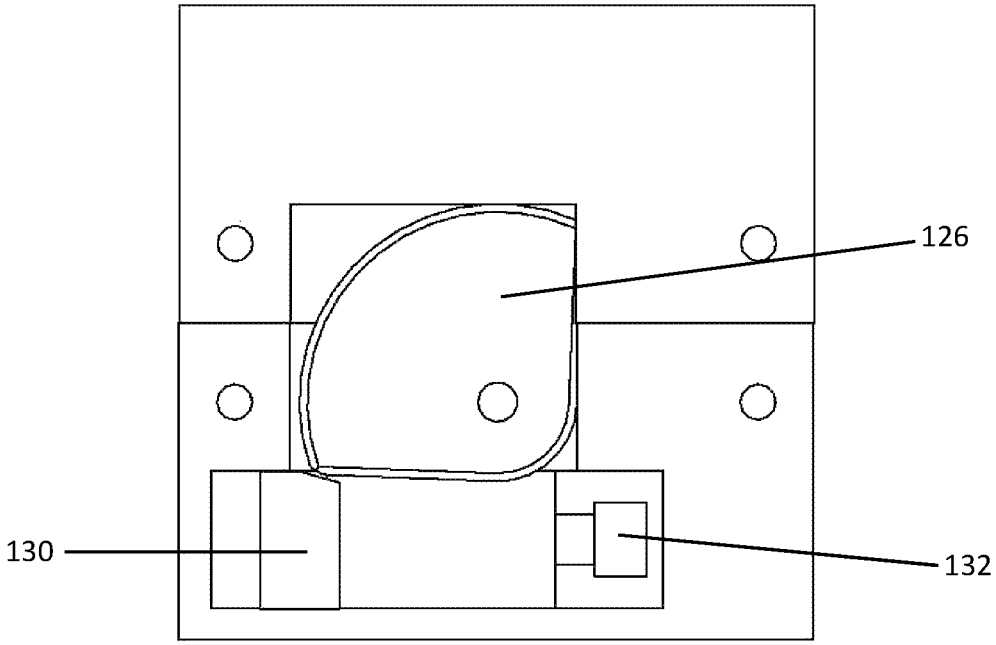
FIG. 8 is a top view of the lock assembly of FIG. 6 showing additional structure, in accordance with embodiments of the present invention.

In FIG. 8, it can be seen that an actuator 132, such as a solenoid, is disposed and arranged in the first body 118 such that the actuator 132 can selectively move the push block 130 from its blocking position to the clearance position. A suitable solenoid for this purpose is a push/pull type solenoid.

Figure 9:
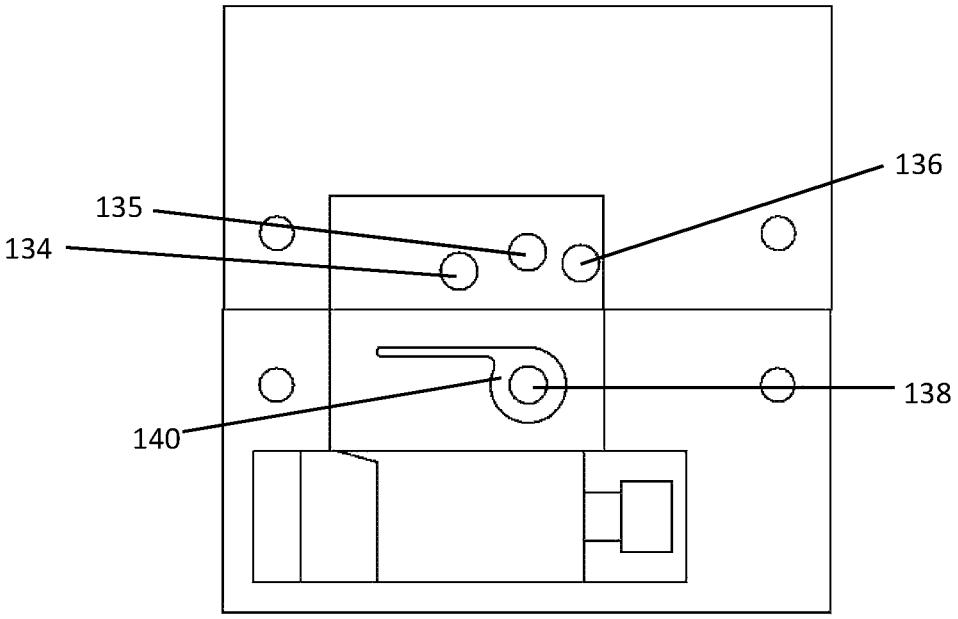
FIG. 9 is another top view of the lock assembly of FIG. 6 showing additional structure, in accordance with embodiments of the present invention.
Figure 10:
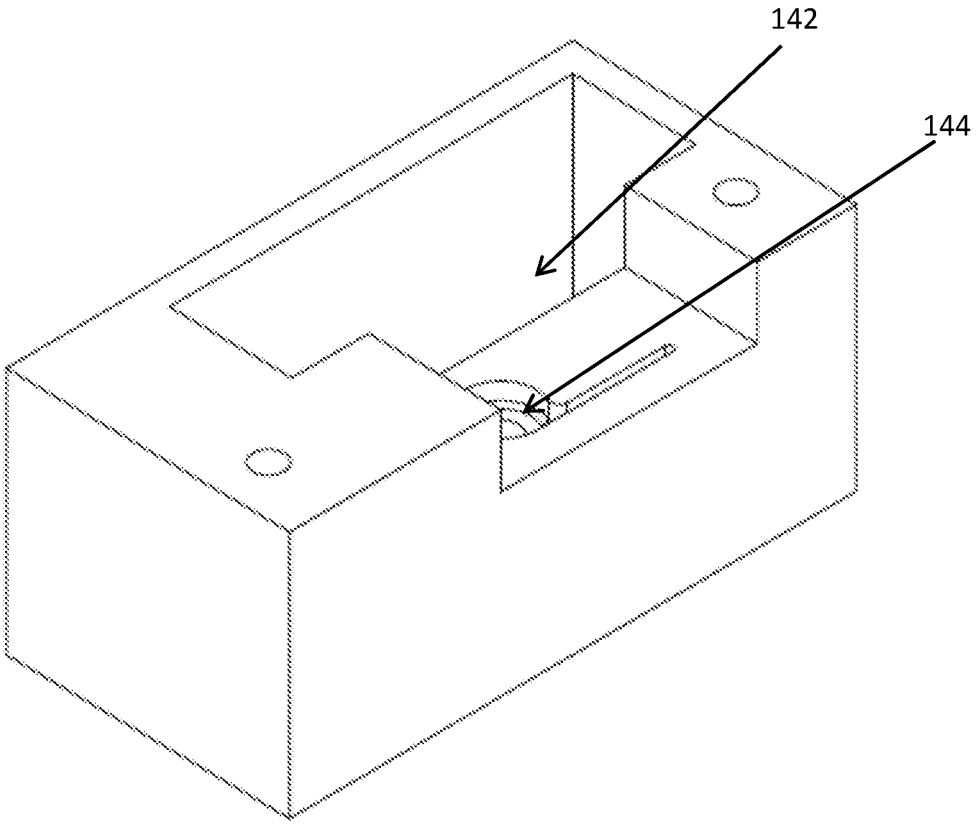
FIG. 10 is a perspective view of a lock body portion of the lock assembly from FIG. 6, in accordance with embodiments of the present invention.
Figure 11:
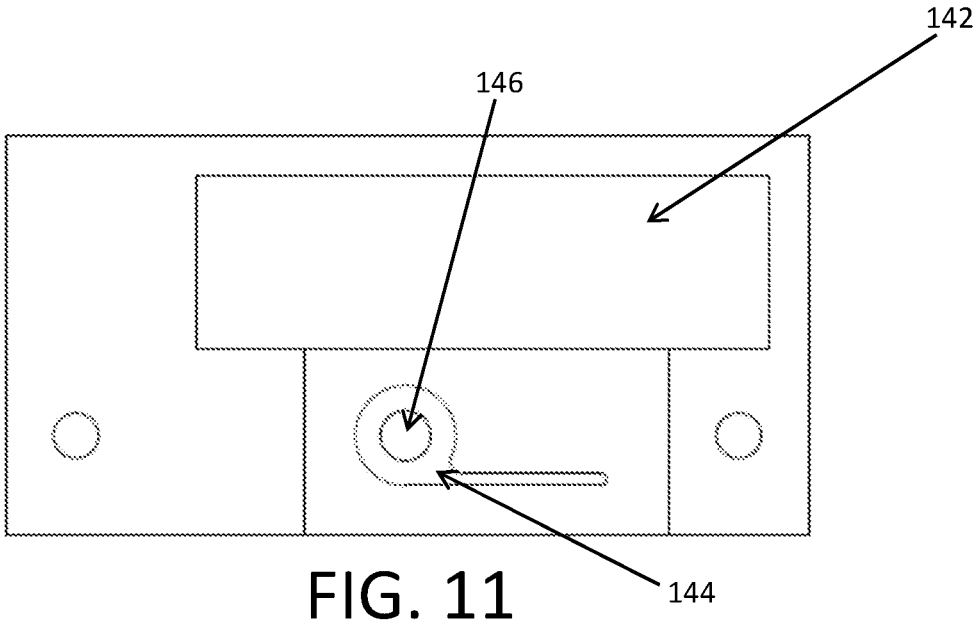
FIG. 11 is a top view of the portion of the lock body shown in FIG. 10.
Figure 12:
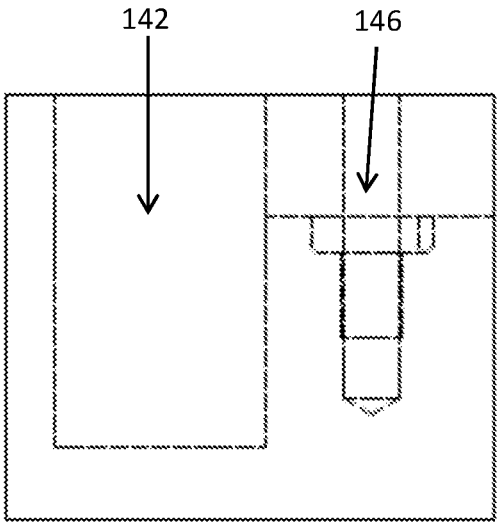
FIG. 12 is a side view of the short side of the portion of the lock body shown in FIG. 10.
Figure 13:
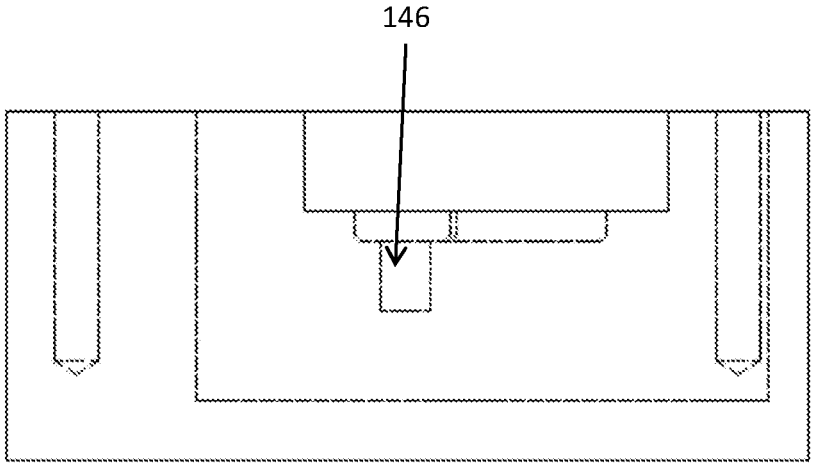
FIG. 13 is a side view of the long side of the portion of the lock body shown in FIG. 10.
Figure 14:
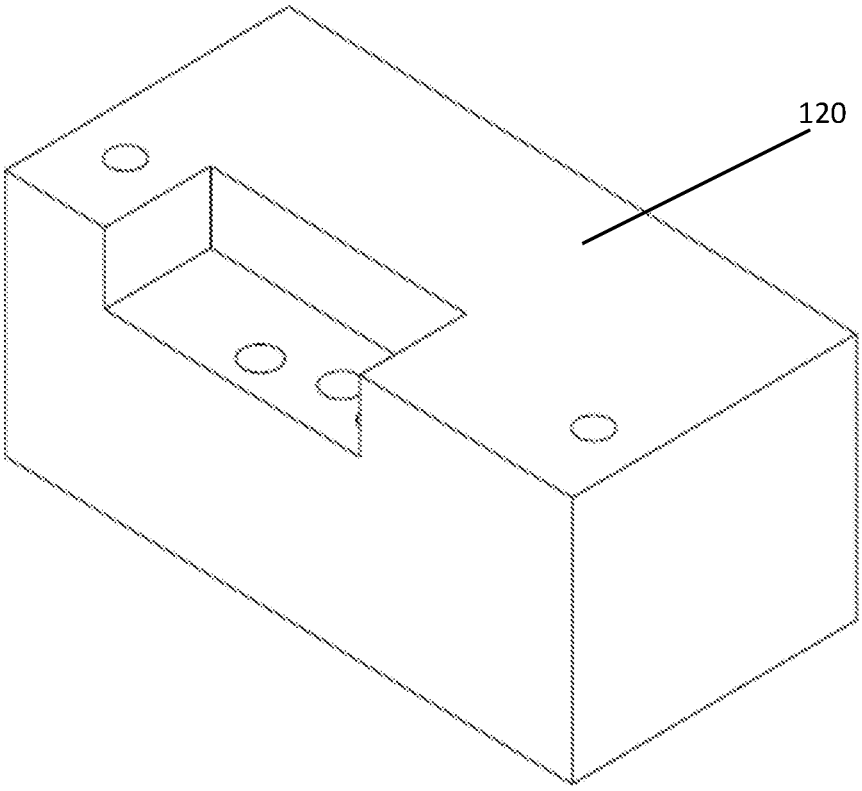
FIG. 14 is a perspective view of another body portion of the lock assembly from FIG. 6, in accordance with embodiments of the present invention.
Figure 15:
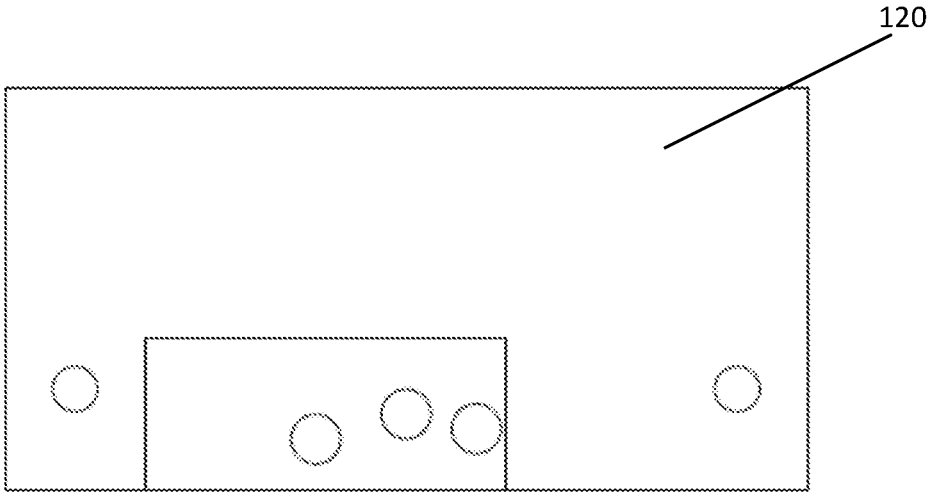
FIG. 15 is a top view of the portion of the lock body shown in FIG. 14.
Figure 16:
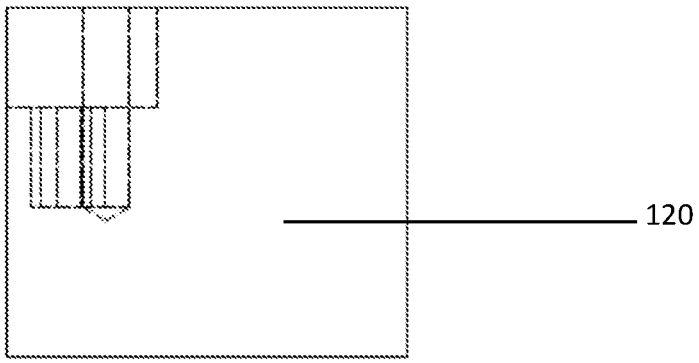
FIG. 16 is a side view of the short side of the portion of the lock body shown in FIG. 14.
Figure 17:
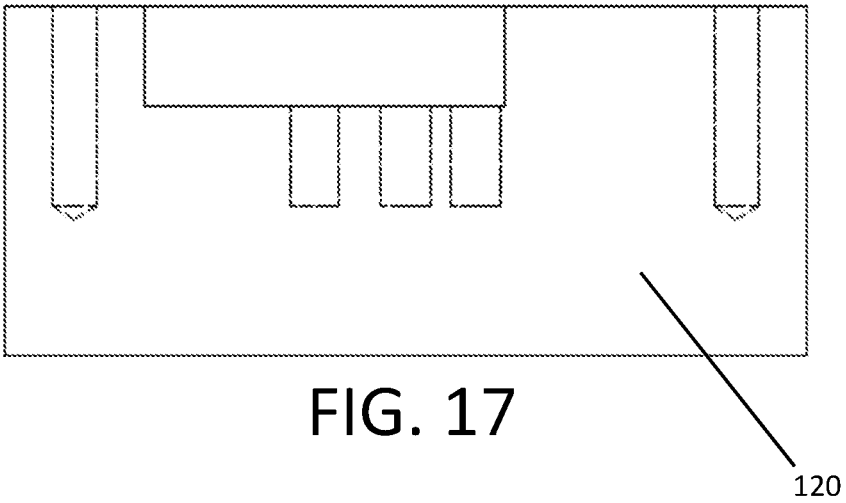
FIG. 17 is a side view of the long side of the portion of the lock body shown in FIG. 16.
Figure 18:
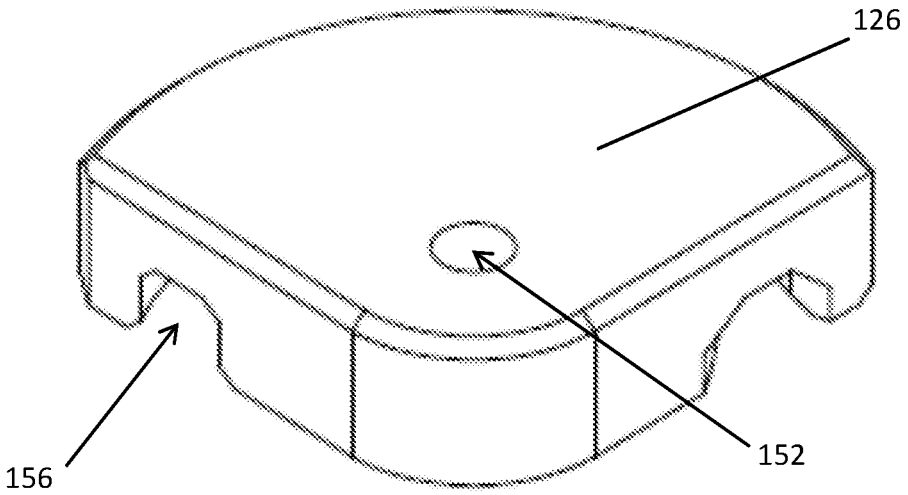
FIG. 18 is a perspective view of a lock wheel of the lock assembly from FIG. 6, in accordance with embodiments of the present invention.
Figure 19:
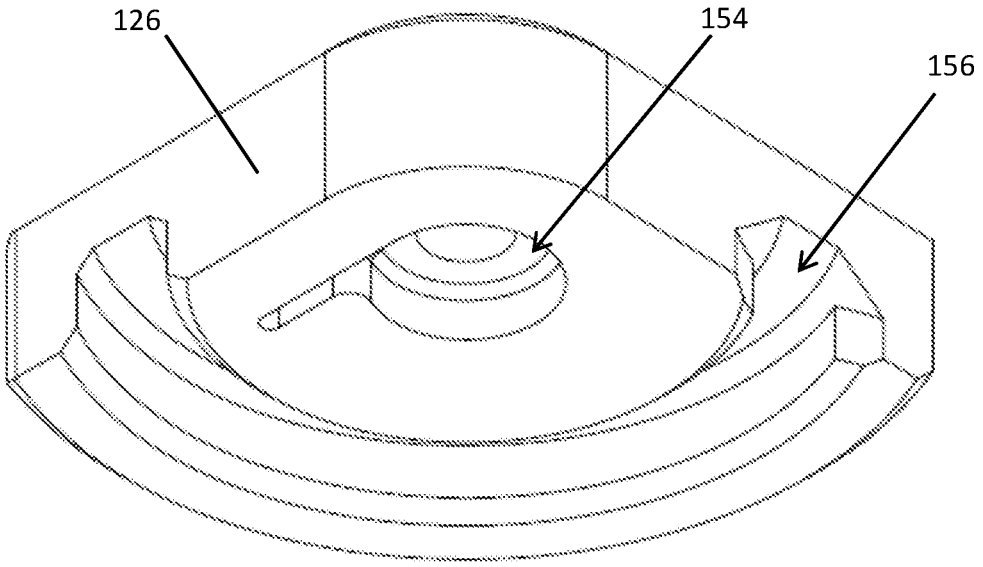
FIG. 19 is another perspective view of the lock wheel of FIG. 18.
Figure 20:
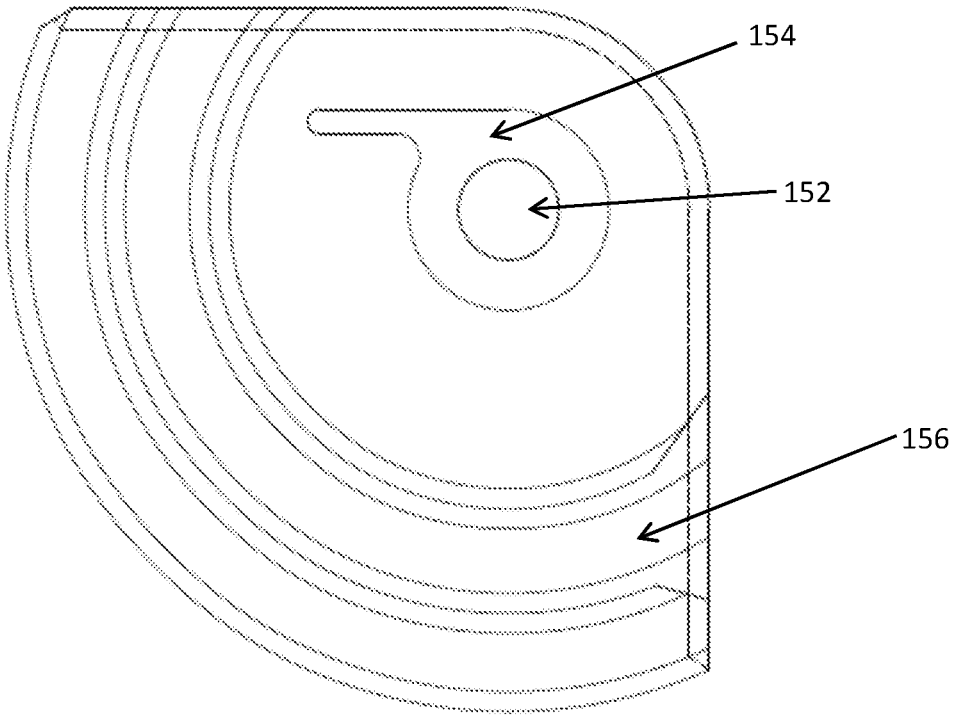
FIG. 20 is a bottom view of the lock wheel of FIG. 18.
Figure 21:
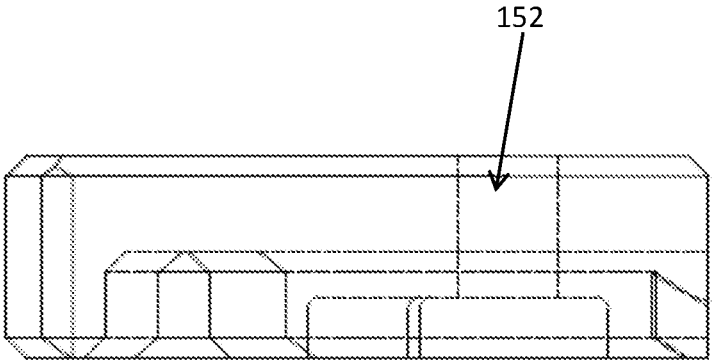
FIG. 21 is a side view of the lock wheel of FIG. 18.
Figure 22:
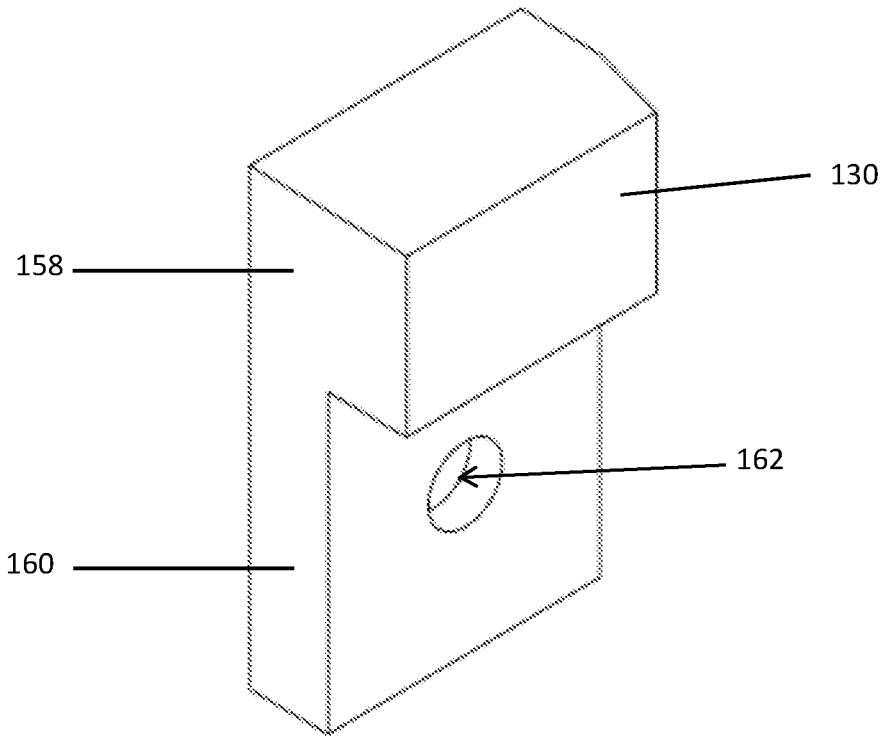
FIG. 22 is a perspective view of a push block of the lock assembly from FIG. 6, in accordance with embodiments of the present invention.
Figure 23:
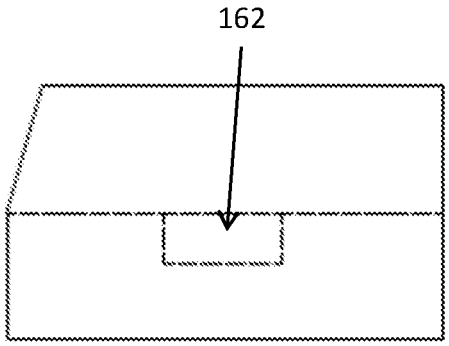
FIG. 23 is an end view of the push block of FIG. 22.
Figure 24:
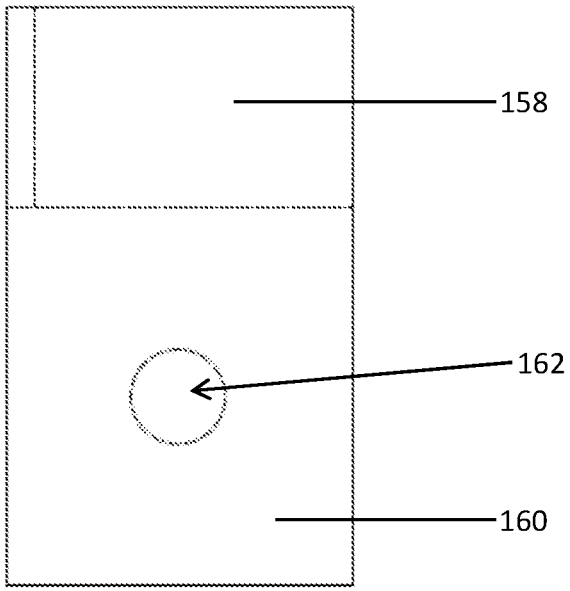
FIG. 24 is top view of the push block of FIG. 22.
Figure 25:
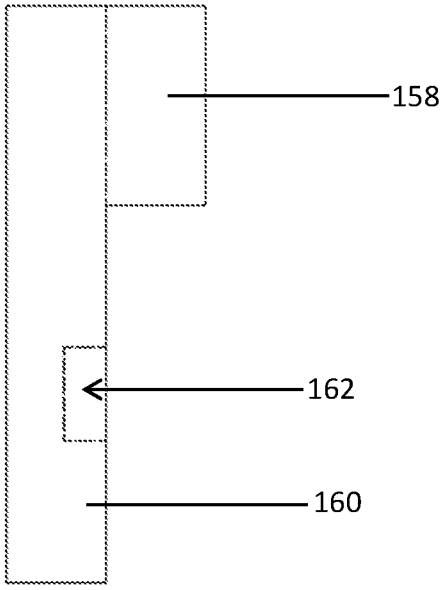
FIG. 25 is a side view of the push block of FIG. 22.

In FIG. 9, the lock wheel 126 has been removed so that a hole for the pivot pin 128 is seen. Additional holes 134, 135, 136 are provided for locking pins that engage the lock wheel by riding in a groove defined with the bottom of the wheel, as will be discussed further below, so that the two lock bodies 118, 120 are locked together (defining a locked state).

It can also be seen that there is an inset 138 for a torsion spring 140 to reside in the first body 118. This spring 140 biases the lock wheel 126 so that it will automatically rotate to the unlocked state when the push block 130 is moved by the actuator 132 into a rotationally permissive position such that the lock wheel 126 can rotate from the locked position to the unlocked position. The user re-locks the lock assembly 116 by turning the handle, which is coupled to the lock wheel 126, which rotates the wheel to the locked position.

The actuator 132 and push block 130 act to mechanically prevent the ability of the lock wheel 126 to rotate into the unlocked position because the push block blocks the wheel 126 from turning. It is only when the push block 130 is moved into the permissive position by the actuator 132 that the lock assembly opens. This allows the lock bodies 118, 120 to be separated (and thus the purse opened by the user).

FIGS. 10-13 are additional views of the first body 118 of the lock assembly 116. The recess 142 for the push block 130 and the recess 144 for the spring 140 are shown. A pin can be provided in a further recess 146 through the spring 140 in order to hold the spring 140 in place.

FIGS. 14-17 are additional views of the second body 120 of the lock assembly 116.

The lock wheel 126 is shown in further detail in FIGS. 18-21. The top side of the wheel 126 is planar and solid except for the hole 152 defined therethrough that the pin goes through that the wheel rotates about. A spring recess 154 is defined into the bottom surface of the wheel 126. The bottom surface also defines a curved groove or channel 156. This groove 156 engages the lock pins disposed in the second body 120 to define the locked position of the wheel 126 and the locked state of the lock assembly 116.

FIGS. 22-25 are additional views of the push block 130. The push block defines an elongated body with a relatively thick head portion 158 and a relatively thin tail portion 160. The head 158 is sufficiently thick to block the rotation of the lock wheel 126 while the tail portion is sufficiently thin to permit the lock wheel 126 to rotate and unlock the lock assembly 116. A depression 162 is formed in the tail portion 160 to permit the actuator 132 to engage the push block 130 and selectively move the block forward and backward within the recess 142.

Figure 26:
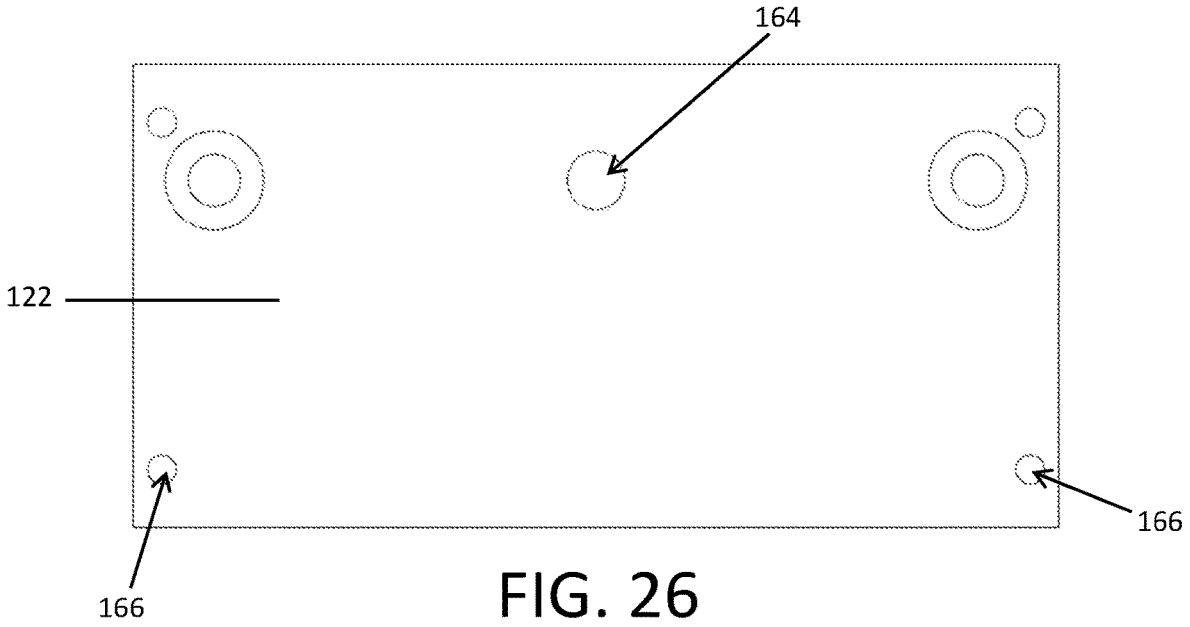
FIG. 26 is a top view of a bottom plate of the lock assembly from FIG. 6, in accordance with embodiments of the present invention.

FIG. 26 shows the top plate 122 that is secured atop the body portions 118 and 120 of the lock assembly 116. The plate contains an aperture 164 for the pin to protrude through that the handle 124 is mounted upon. There are also several apertures 166 for fasteners (e.g. screws) to extend through into the bodies 118, 120 to secure the plate 122 in place.

Figure 27:
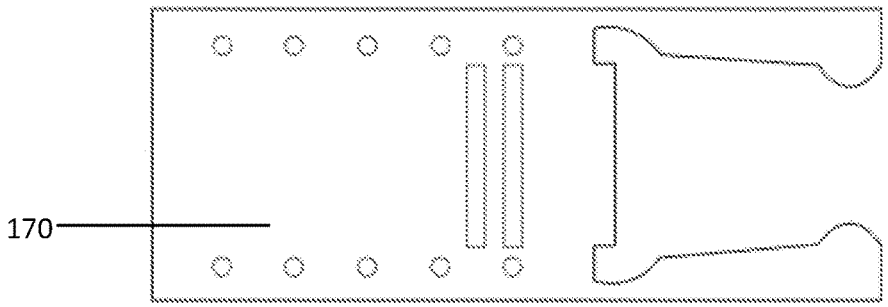
FIG. 27 is a front view of a first part of a strap force release mechanism, in accordance with embodiments of the present invention.
Figure 28:
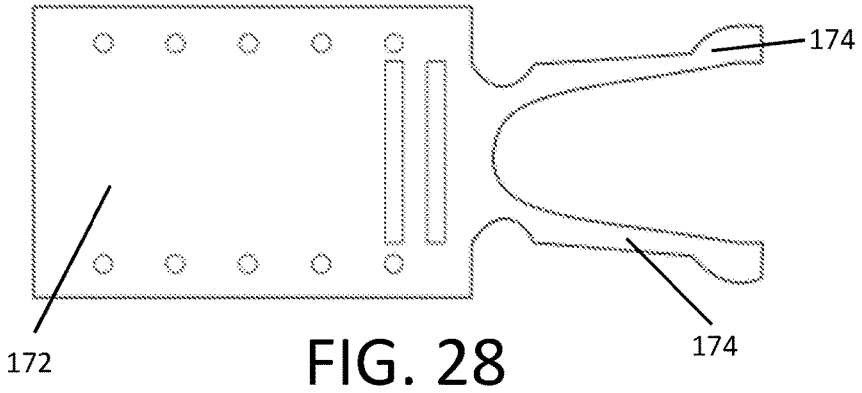
FIG. 28 is a front view of a second part of a strap force release mechanism, in accordance with embodiments of the present invention.

Referring to FIGS. 27-28, a force sensitive shoulder strap connector can be provided to the purse or bag that will easily release to protect the user from bodily harm at the shoulder, collarbone, and neck if the purse is being pulled while on the body. FIG. 27 is the female half 170 of the connector and FIG. 28 is the male half 172 of the connector. The amount of force required to pull the male half 172 out of the female half 170 is controlled by the spring force of the flanges 174 of the male half 172 and the shape of the flanges themselves as compared to the corresponding contours of the female half 170.

An electrical circuit can be completed when the two halves 170, 172 of the strap connector are joined. This allows the main microprocessor to initiate a panic alarm when the strap is unlatched because the circuit is broken. The alarm can also be remotely actuated via a smartphone app that is wirelessly linked to the purse. In such embodiment, a wireless (e.g., cellular and/or Wi-Fi) transponder is included in the purse and powered by the battery.

Figure 29:
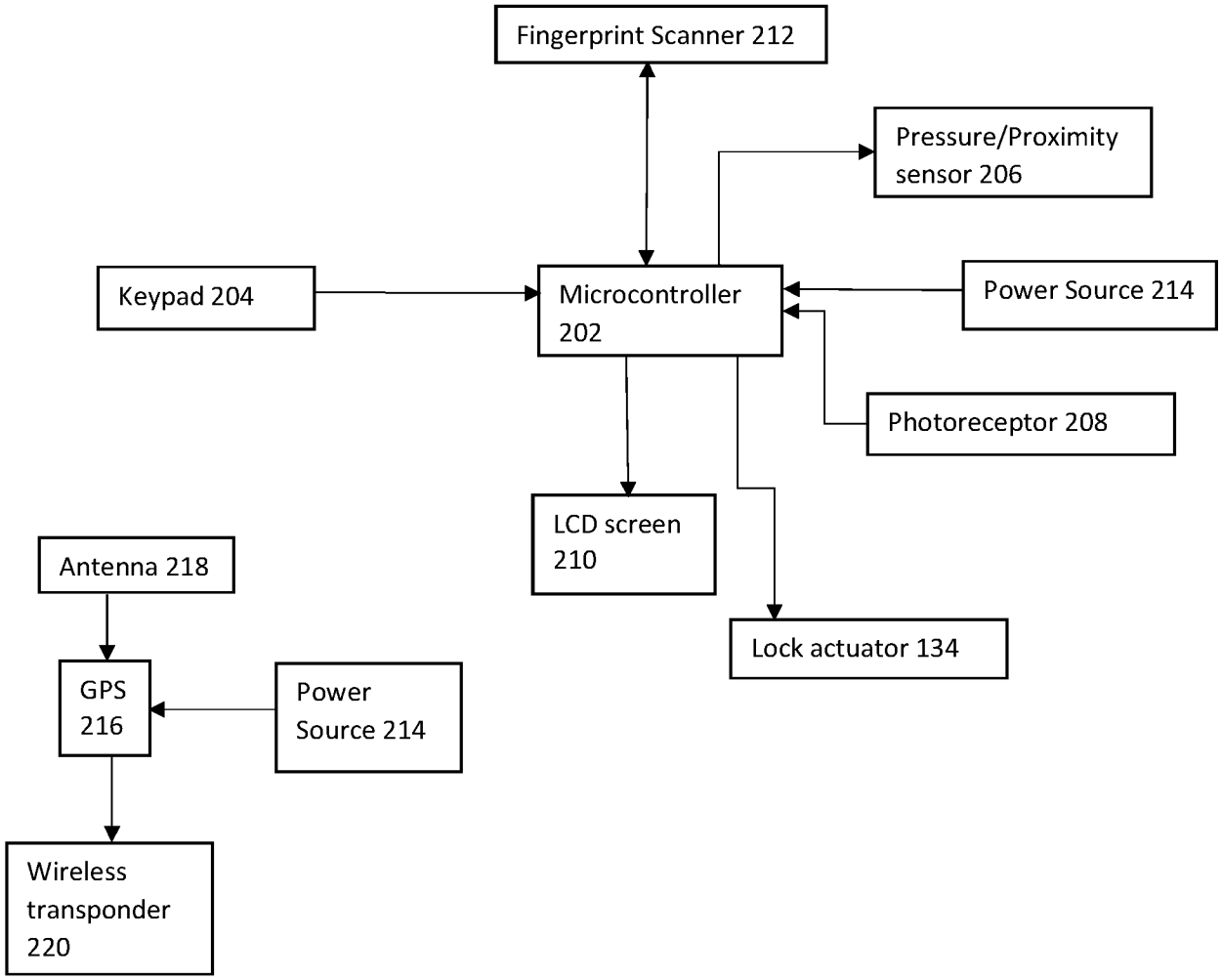
FIG. 29 is a component diagram, in accordance with embodiments of the present invention.

Referring to FIG. 29, various electrical components purse 100 will now be discussed. A microcontroller (i.e., processor) 202 governs the operation of the main purse functions. A keypad 204 is coupled to the microcontroller 202 and receives a passcode from the user, which can be used as an alternative to the fingerprint scanner. The keypad 204 is also required to enroll a new user fingerprint. The microcontroller 202 is coupled to a pressure/proximity sensor 206, a photoreceptor 208, the lock assembly actuator 132, an LCD screen 210 and a finger print scanner (FPS) 212.

The FPS 212 can be discretely integrated into an exterior surface of the purse (such as shown in FIG. 1) or into the lock assembly 116. The FPS 212 records a fingerprint and sends it to the microcontroller 202 for verification that the user is authorized to access the interior of the purse. Any other type of biometric sensor can be provided in place of, or in addition to, the FPS.

Only after the user's privileges are verified will the microcontroller 202 initiate the actuator to move the push block 130 to a position that allows the lock wheel 126 to turn and unlock the lock assembly 116.

The pressure/proximity sensor 206 can be incorporated into the lock assembly to sense when the bodies 118 and 120 of the lock assembly 116 are joined so that the microcontroller 202 knows whether the purse is in a closed state or open state.

The photoreceptor 208 is an alternative means to determine the closed/open state of the purse. The photoreceptor 208 works with an LED incorporated into the opposing body portion of the lock assembly to detect light. If the photoreceptor is receiving light, the purse is open. If it is not, the purse is closed.

The LCD screen 210 can be disposed in an exterior surface of the purse to display status information such as battery capacity remaining, various operational information, user option selection, debugging options or displaying any type of information as desired. The display 210 can be covered by an exterior panel of material or can be omitted entirely.

The electronics are all powered by an onboard power source 214 such as a battery. The battery can be a commercially available battery (e.g., lithium chemistry) for its compact size and long life. The microcontroller 202 is coupled to the battery 214 to monitor the battery state. The microcontroller 202 provides an indication to the user when the battery needs to be recharged. A small LED indicator or the LCD display can be used for this purpose. The battery can be recharged via conventional connectors via a port provided through the purse exterior. The battery can also be wirelessly charged. The battery can also be made replaceable.

A global positioning system (GPS) transmitter 216 can also be provided to the purse 100. In the event that the purse is stolen, the purse can be tracked via the GPS transponder. This is also handy to simply find a misplaced purse. The GPS decoder chip 216 is connected to an antenna 218 to decode the GPS data. The GPS chip 216 is coupled to a wireless transponder 220 that can broadcast the purse's GPS coordinates to the user's mobile phone and/or to law enforcement personnel. The wireless transponder can be cellular, Wi-Fi or other type of wireless communications transponder. The GPS chipset 216 and wireless transponder 220 are also powered by the onboard power source 214.

An external port can be provided through the purse lining to allow for a charging cord to be plugged in. The battery may also be charged via contactless charging methods, or via other suitable means, in other embodiments.

In use, the user provides an input, such as a fingerprint, to the biometric sensor 212. The microcontroller 202 verifies that the user has access privileges, and if affirmative, causes the actuator 134 to move the push block 130 into the permissive state such that the lock wheel 126 can rotate from the locked positon to the unlocked position. Thus, only the user and approved persons recognized by the scanner are allowed access to the purse/bag contents. Should the battery die for any reason, the lock remains closed. Once the purse is closed, the user can turn the handle to lock the lock assembly.

If the purse remains opened for more than a preset time period, the microcontroller 202 can provide a notice to the user via a visual indicator such as an LED light.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

For purposes of interpreting the claims for the present invention, it is expressly intended that the provisions of 35 U.S.C. § 112(f) are not to be invoked unless the specific terms "means for" or "step for" are recited in a claim.

What is claimed is:

1. A bag for containing valuables, comprising:

a rigid endoskeleton defining an interior space, the rigid endoskeleton comprising:

a horizontally-extending base member;

a horizontally-extending top member; and a plurality of transverse members extending between the top member and the base member;

an exterior covering disposed over an entirety of the rigid endoskeleton;

a lock assembly coupled to the endoskeleton and arranged to prevent access to the interior space when the lock assembly is in a locked state, the lock assembly including:

a handle;

an actuator, the actuator arranged within the lock assembly to selectively allow the lock assembly to unlock from a locked state;

a lock body;

a lock wheel disposed at least partially within the lock body;

a push block; and a torsion spring coupled to the lock body and the lock wheel which is arranged to bias the wheel to turn from a locked position to an unlocked position when the push block is in a rotational permissive position;

a biometric sensor provided to the bag; and a microcontroller coupled to the biometric sensor and the actuator, the microcontroller being programmed to determine whether an input provided to the biometric sensor corresponds with an authorized user and, if affirmative, activate the actuator to allow the lock assembly to achieve the unlocked state, and if negative, to not allow the lock assembly to achieve the unlocked state.

2. The bag of claim 1, wherein the bag is configured as a purse.

3. The bag of claim 1, further including a shoulder strap, the shoulder strap comprising a first end coupled to the rigid endoskeleton and an opposing second end coupled to the rigid endoskeleton.

4. The bag of claim 3, wherein at least one of the first and second ends is coupled to the rigid endoskeleton via a force sensitive shoulder strap connector, the connector configured to decouple when a force above a preset threshold is applied to the shoulder strap.

5. The bag of claim 1, wherein the horizontally-extending base member comprises a planar base plate and the plurality of transverse members comprise a plurality of rigid cables.

6. The bag of claim 1, further comprising a slash-resistant inner lining provided to the interior space of the endoskeleton.

7. The bag of claim 1, further comprising a power source coupled to the microcontroller, wherein the power source is a battery.

8. The bag of claim 7, wherein the battery is configured for wireless charging.

9. The bag of claim 1, wherein the lock wheel rotationally is disposed at least partially within the lock body via a pivot pin;

wherein the push block is disposed within the lock body and arranged with respect to the lock wheel such that the push block defines a rotational blocking position and a rotational permissive position;

wherein the actuator is coupled to the push block to move the push block between the rotational blocking position and the rotational permissive position; and wherein a handle coupled to the lock wheel so that the lock wheel can be manually rotated by the user from the unlocked position to the locked position.

10. The bag of claim 9, wherein the push block defines a head portion that is relatively thicker as compared to a tail portion thereof.

11. The bag of claim 1, wherein the biometric sensor is a finger print scanner.

12. The bag of claim 1, wherein the actuator is a solenoid.

13. The bag of claim 1, wherein the lock assembly includes a lock state sensor coupled to the microcontroller.

14. The bag of claim 13, wherein the lock state sensor is a photoreceptor or a proximity sensor.

15. The bag of claim 1, further comprising a global positioning system (GPS) decoder coupled to a wireless transponder and the microcontroller, wherein the microcontroller is further programmed to cause the wireless transponder to broadcast the GPS location coordinates of the bag.

16. The bag of claim 1, further including an audible panic alarm coupled to the microcontroller.

17. A method of securing a bag against unauthorized access to a contents of the bag, the method comprising:

receiving a biometric input from a user via a biometric sensor that is provided to the bag;

determining whether the biometric input provided to the biometric sensor corresponds with an authorized user;

providing an endoskeleton completely within the interior of the bag, the endoskeleton comprising a top support member, a base member and a plurality of transverse members extending between the top support member and the base member;

activating an actuator in a lock assembly to place the lock assembly into an unlocked state from a locked state by moving a push block which permits a lock wheel to rotate from a locked position to an unlocked position; and biasing a wheel of the lock assembly to turn from the locked position to the unlocked position via a torsion spring provided to the lock assembly when the push block is in a rotational permissive position.

18. The method of claim 17, further comprising triggering a panic alarm if a strap of the bag is uncoupled from the bag on at least one end of the strap.

19. The method of claim 17, further comprising broadcasting wirelessly a set of GPS coordinates for the bag by a transponder provided to the bag.

20. The bag of claim 1, wherein the push block defines a head portion that is relatively thicker as compared to a tail portion thereof.

* * * * *